United States Patent [19]

Bakgaard

[11] 4,031,321

[45] June 21, 1977

[54] LOUDSPEAKER SYSTEMS

[75] Inventor: Knud Erik Bakgaard, Struer, Denmark

[73] Assignee: Bang & Olufsen A/S, Denmark

[22] Filed: Feb. 17, 1976

[21] Appl. No.: 658,526

Related U.S. Application Data

[63] Continuation of Ser. No. 521,094, Nov. 5, 1974, abandoned.

[30] Foreign Application Priority Data

Nov. 6, 1973 United Kingdom ..... 51482/73

[52] U.S. Cl. ..... 179/1 D

[51] Int. Cl.[2] ..... H04R 1/24; H04R 3/04; H04R 3/14

[58] Field of Search ..... 179/1 D

[56] References Cited

UNITED STATES PATENTS 3,838,215 4/1973 Haynes, Jr. ..... 179/1 D

OTHER PUBLICATIONS

"Choosing Your Crossovers", by Norman H. Crowhurst, Radio & TV News, Oct. 1957, pp. 51–54 & 100.

*Primary Examiner*—George G. Stellar
*Attorney, Agent, or Firm*—Craig & Antonelli

[57] ABSTRACT

A loud speaker system comprising a first and a second main driver connected to common signal input terminals through crossover network means designed so as to pass signals of frequencies lower than a predetermined crossover frequency to said first driver and signals of frequencies higher than said crossover frequency to the said second driver, while in a crossover frequency range the signals are passed to both drivers with an amplitude which for increasing frequencies is decreasing for said first driver and increasing for said second driver in such a manner that the transfer function of the loud speaker system is approximated to a constant function inside and outside said crossover frequency range, and further comprising an auxiliary driver designed to work in said crossover frequency range and fed through filter means so as to have a transfer function which is substantially complementary of the deviation of the combined transfer function of the two main drivers from the constant function outside the crossover frequency range, whereby the auxiliary driver will compensate for the said deviation in an acoustic manner and thus cause the total transfer function of the system to be as constant as desired for a good quality of the sound reproduction. Moreover, even the phase distortion problems in loudspeaker systems are reduced or eliminated in a system according to the invention.

13 Claims, 10 Drawing Figures

LOUDSPEAKER SYSTEMS

This is a continuation of application Ser. No. 521,094, filed Nov. 5, 1974, now abandoned.

The present invention relates to loud speaker systems of the multiple-driver type including two or more loud speakers designed to operate in mutually different frequency ranges and a crossover network serving to divide the input signal to the loud speaker system or unit so as to feed each of the loud speakers with signals of the respective frequency ranges only. Normally there are two loud speakers, viz. one low frequency driver or "woofer" and one high frequency or "tweeter" adapted to operate, respectively, below and above a certain crossover frequency of e.g. somewhere between 400 and 1000 Hz. By operating the woofer at the low frequencies only it is ensured that the high frequency oscillations are not superimposed on the slowlier reciprocating membrane of the woofer whereby a modulation distortion is prevented or at least counteracted.

It is well known that with the use of ordinary passive crossover networks there are some problems in obtaining a fully correct performance of the loud speaker unit in the crossover frequency range, and these problems shall be described briefly in the following with reference to FIGS. 1–5 of the accompanying drawing.

In the drawings:

FIG. 1 is a two-way crossover arrangement.

FIGS. 2–5 illustrate the operation of a second order two-way crossover arrangement wherein FIG. 2 illustrates the individual frequency responses of the drivers, FIG. 3 illustrates the resultant sum signal of the two drivers in the region of the crossover frequency, FIGS. 4 and 5 illustrate sum and difference square wave responses, respectively FIG. 6 illustrates how a two-way crossover response modified in accordance with the invention by the addition of a third driver in the crossover region.

FIG. 8 illustrates how a two-way crossover response may be modified in accordance with the invention by the addition of third and fourth drivers in the crossover region.

Figure 1:
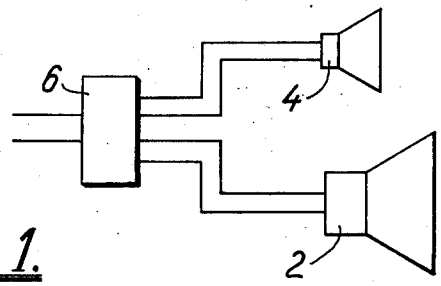
Figure 2:
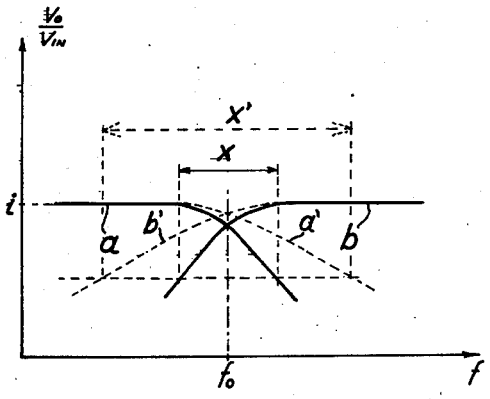

In FIG. 1 there is shown a woofer 2, a tweeter 4, and a crossover network 6. As an example the crossover frequency is 500 Hz, and the two drivers 2 and 4 are designed for operation below and above this frequency, respectively. In an ideal system the network 6 should be able to divide the input signal sharply at 500 Hz so as to send all lower frequencies of the complex input signal exclusively to the woofer 2 and all higher frequencies exclusively to the tweeter 4, but in practice this is not possible. Ordinary networks 6 are designed in such a manner that there is a certain overlapping between the low and high frequency signals sent to the two drivers 2 and 4 as far as frequencies adjacent the crossover frequency are concerned. A typical example is illustrated in FIG. 2 in which the curve *a* represents the amplitude of the signal supplied to the woofer as a function of the frequency of the signal while the curve *b* is a corresponding curve referring to the tweeter 4. The crossover frequency is designated $f_o$ and the crossover frequency range is designated *x*.

Within the crossover frequency range *x* the different frequencies of a complex input signal are supplied to both of the drivers 2 and 4, and it will be readily understood that in order to obtain a resulting sound signal of an intensity corresponding to the intensity of the sound signals below and above the frequency range *x* the network 6 should be so adapted that the intensity of the combined signal from the two drivers within the range *x* remains as close as possible to the intensity level *i* of the horizontal portions of the curves *a* and *b*.

As well known the network 6 comprises pass filters which may be of first, second or even higher order. A higher order of the filter involves an increased inclination of the curve portion inside the range *x* and thus a decreased width of the range *x*. The use of first order filters is optimal as far as the theoretical constance of the signal intensity outside and inside the range *x* is concerned, but the corresponding small inclination of the curves *a* and *b* inside the range *x* makes it imperative that both of the drivers are designed to operate well beyond the crossover frequency at the respective opposite sides thereof, and in practice it is very difficult to design high quality loud speakers for such a wide frequency range.

The curves *a* and *b* in FIG. 2 represent a second order filter, and for illustration there is in dotted lines shown two corresponding curves *a'* and *b'* relating to a first order filter network. It will be noted that the crossover frequency range, designated *x'* and in which both drivers shall be operative, is hereby considerably enlarged.

For a better understanding it should be mentioned that the so-called transfer function of a crossover network of first order, i.e. the voltage output for a constant voltage input as a function of the frequency of the signal, is given by the expression $$\frac{V_0}{V_{in}} = \frac{1}{s+1}$$

for the woofer, *s* conventionally substituting the term $$\frac{j\omega}{\omega_0}, \text{ and } \frac{s}{s+1}$$

for the tweeter. From this it will be clear that the sum signal will be $$\frac{1}{s+1} + \frac{s}{s+1} = \frac{s+1}{s+1} = 1,$$

i.e. the amplitude of the resulting signal from both drivers will be in the same inside as outside the frequency range *x'* in case of a first order filter network.

However, as indicated above, it is desirable to use a higher order filter network in order to reduce the effective frequency range of the loud speakers used in the unit, and in the following specific attention will be paid to a second order filter or crossover network as commonly used. (Butterworth-Filters)

Figure 3:
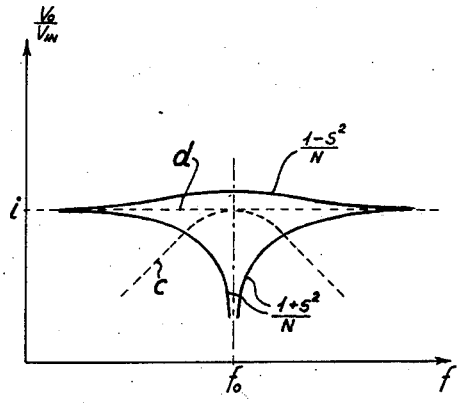

With the use of a second order filter network the curves *a* and *b* inside the range *x* will approach an inclination of 12 dB per octave while the inclination is only 6 dB per octave for a first order filter network. The said transfer function is $$\frac{1}{s^2+\sqrt{2}s+1}$$

for the woofer and $$\frac{s^2}{s^2+\sqrt{2}s+1}$$

for the tweeter. In FIG. 3 it is illustrated that the resulting amplitude of the sum signal $$\frac{1+s^2}{N}\left(N=s^2+\sqrt{2}s+1\right)$$

is highly non-uniform adjacent the crossover frequency $f_o$, while the vectorial difference signal $$\frac{1-s^2}{N}$$

produces a resulting transfer function fairly close to the level *i* of the transfer function of the two drivers outside the range *x*. Therefore, in order to provide for an almost constant amplitude of the reproduced sound signal, it is normally preferred to use a resulting difference signal, it is normally preferred to use a resulting difference signal, i.e. to let the two drivers work in counterphase.

Figure 4:
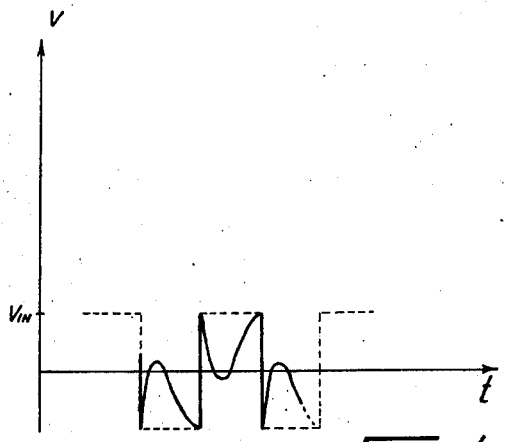
Figure 5:
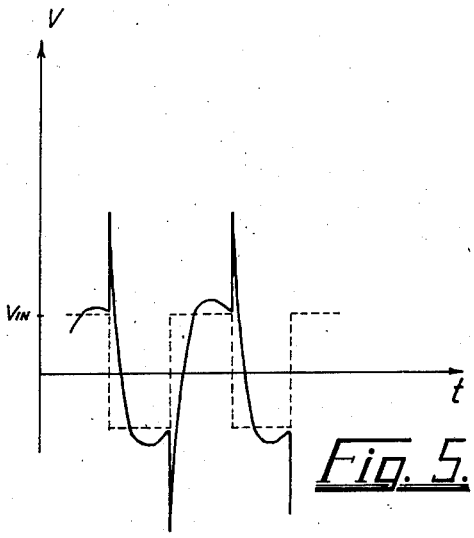

For a high quality sound reproduction, however, it is not sufficient to consider the amplitude or intensity of the signal, since also the degree of distortion of the wave form of the resulting signal as compared with the input signal is important. While the distortion of the sound reproduced by the single drivers in their respective frequency ranges may generally be kept low, the distortion in the crossover frequency range will be much more expressed owing to the drivers being different and owing to the operation of the crossover network, and of course in this respect it makes a considerable difference whether the drivers are connected in phase or in counterphase so as to produce a resulting sound signal which is a sum signal or a difference signal, respectively, of the signals produced by the single drivers. As well known, a good manner of registering the resulting wave form distortion is to feed to the unit an input signal of square wave form, such a signal in fact comprising a wide range of frequencies of which some are within the crossover frequency range, and to measure the wave form of the resulting sound signal, this latter wave form for a sum signal being represented in FIG. 4 and for a difference signal in FIG. 5, both for a crossover network of second order, the input square signal being shown in dotted lines.

It will be seen that the distortion from the square form is expressed in both cases, but apparently the most serious distortion is that of the difference signal (FIG. 5), because the sharp peaks thereof adds kind of "hardness" to the resulting sound signal. On the other hand, the amplitude phenomena described in connection with FIG. 3 are decisive for the choice of the sum or difference operation of the two loud speakers, so in practice the difference operation is used despite the relatively expressed wave form distortion.

$$\frac{V_o}{V_{in}}$$

has already been suggested to improve the operation of the loud speaker unit by designing the crossover network in such a manner that the transfer functions V in of one or the two drivers are changed so as to give the sum one instead of the usual $$\frac{1}{s^2+\sqrt{2}s+1}+\frac{s^2}{s^2+\sqrt{2}s+1}$$

whereby the amplitude in the crossover frequency range will not change with the frequency. These special networks, however, are rather expensive, and they give rise to considerable losses. Moreover, they involve the disadvantage that one or both drivers shall work in an enlarged effective frequency range.

It should be mentioned that in known systems or units with three or even more drivers there is a crossover network for each pair of consecutive drivers, and the problems discussed above are actual for the crossover between the two drivers of each of these pairs.

It is the purpose of this invention to provide a loud speaker system or unit in which an improved crossover function is obtained in a simple and effecient manner. The invention is based at the idea that instead of correcting the transfer functions of one or both of the drivers it is possible to obtain sufficient correction in an electroacoustic manner by adding an auxiliary driver designed to operate in the crossover frequency range and having such a transfer function that the resulting or combined transfer function of the three drivers is a constant.

According to the invention, therefore, there is provided a loud speaker system of the type referred to, in which in addition to said two drivers there is provided at least one auxiliary compensation driver adapted to work in said crossover frequency range and being operable to reproduce an acoustic signal with a frequency-amplitude-characteristic which, combined with the corresponding characteristics of the two main drivers, results in the total transfer function of the loud speaker system being substantially constant inside and outside the crossover frequency range.

Basically, therefore, the invention provides for a loud speaker system including two ordinary loud speakers and an ordinary crossover network of second or higher order defining a transfer function of $G_L$ and $G_H$ for the respective loud speakers, and further including an auxiliary loud speaker having a transfer function $G_A$ given by the expression $G_L+G_H+G_A=K$, K being a constant. Normally, as mentioned, $G_L$ and $G_H$ are expressed as $$G_L=\frac{1}{s^2+\sqrt{2}s+1}=\frac{1}{N} \text{ and } G_H=\frac{s^2}{s^2+\sqrt{2}s+1}=\frac{s^2}{N}$$

and it is sufficient, therefore to feed the auxiliary driver through a filter designed so as to produce a transfer function $$G_A=\frac{\sqrt{2}s}{s^2+\sqrt{2}s+1}=\frac{\sqrt{2}s}{N},$$

since it will be noted that $$G_L + G_H + G_A = \frac{1 + s^2 + \sqrt{2}s}{1 + \sqrt{2}s + s^2} = \frac{N}{N} = 1.$$

Thus, the total transfer function will be almost optimal, i.e. even better than the function illustrated by the difference signal in FIG. 3.

For a person skilled in the art there is no difficulty in designing a filter which produces the transfer function $$\frac{\sqrt{2}s}{N},$$

for the auxiliary loud speaker, and the filter design, therefore, will not be described in more detail at this place.

Figure 6:
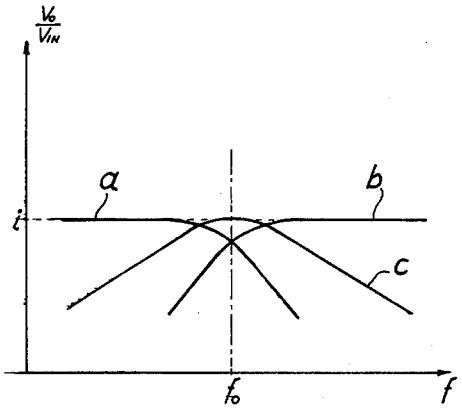

It will be noted that the transfer function $as/N$ of the auxiliary driver is of first order, i.e. the inclination approached by the amplitude-frequency curve as illustrated by the curve *c* in FIG. 6 is 6 dB per octave only, at both sides of the crossover frequency. However, the necessary operative frequency range of the auxiliary loud speaker will not be very broad anyway, so it is easy to design a loud speaker for this purpose.

Figure 7:
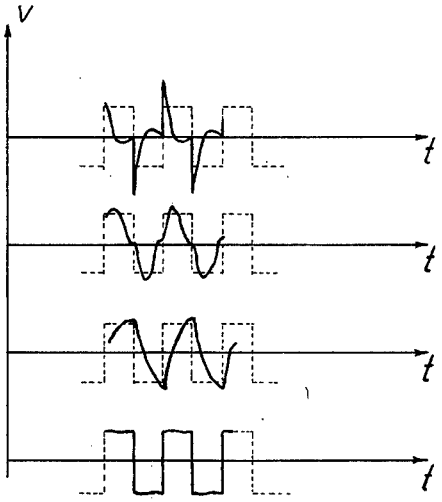
FIG. 7 illustrates the square wave response of the individual drivers of the invention and of the resultany sum.

The square signal transfer of each of the loud speakers is illustrated in FIG. 7, and also the wave form of the resulting or total sound signal is shown; it will be appreciated that the square form is reproduced almost exactly by the vectorial addition of the signals from the three loud speakers.

It will be noted that contrary to normal practice the two ordinary loud speakers should be connected so as to work in phase with each other, i.e. so as to produce the sum signal illustrated in the lower half of FIG. 3. In this FIG. the curve *c* of FIG. 6 is shown in dotted lines, and it will be noted that the two curves are complementary so as to add themselves into a straight line *d*.

Within the scope of the invention it would be possible theoretically to let the ordinary or main drivers be connected in counterphase and compensate the resulting difference signal by means of the auxiliary driver; it can be demonstrated, however, that in practice this would require the use of two auxiliary drivers having mutually different transfer functions, so this solution is not the most attractive.

Generally $$G_L = \frac{a_0}{N}$$

acoustic compensation or correction according to the invention will be applicable in connection with all higher order crosswork networks. A network of the order *n* defines for the woofer a transfer function *G* and for the tweeter a transfer function $$G_H = \frac{a_n s^n}{N},$$

N being equal to $a_o + a_1 s + a_2 s^2 + .... + a_n s^n$. The combined signal of the two main loud speakers is $$\frac{a_0 + a_n s^n}{N},$$

and for bringing the amplitude of the resulting signal into independency of the frequency it will be sufficient to add a further sound signal defined by the transfer function $$G_A = \frac{a_1 s + a_2 s^2 + \ldots + a_{n-1} s^{n-1}}{N}.$$

Figure 8:
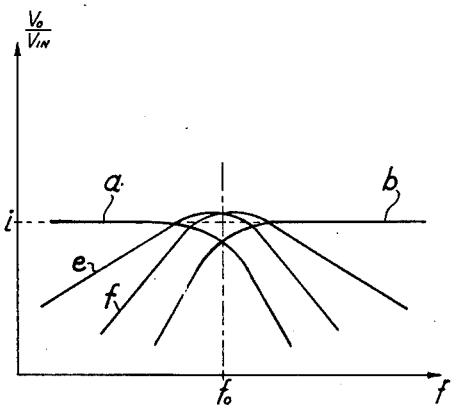
FIG. 8 illustrates how a two-way crossover response

This signal can be produced by means of a number of n-1 auxiliary loud speakers having the transfer functions $$\frac{a_1 s}{N}, \frac{a_2 s^2}{N}, \ldots, \frac{a_{n-1} s^{n-1}}{N},$$

respectively. As an example FIG. 8 illustrates the use of a third order crossover network and two auxiliary loud speakers having the transfer functions $$\frac{2s}{N_3} \text{ and } \frac{2s^2}{N_3},$$

respectively. It will be noted that the curves *e* and *f* representing these functions approach different inclinations at the two sides of the crossover frequency. On the other hand it is characteristic for the invention that the transfer function curve of any auxiliary loud speaker is inclined at both sides of the crossover frequency and not only at one side thereof.

In a unit according to the invention in which there is mounted three main loud speakers, viz. a woofer, a tweeter and a driver for the intermediate frequency range, it may be sufficient to make use of the acoustic compensation in the crossover range between the woofer and the intermediate driver, especially of course if the crossover network between the intermediate driver and the tweeter is of first order.

For the above calculation of the transfer function $G_A$ of the auxiliary driver or drivers it is important that the low pass filter of the woofer and the high pass filter of the tweeter are of the same order, since the denominator N would not otherwise be the same in the two expressions for $G_L$ and $G_H$. It will be understood, however, that it may nevertheless be possible to effect some acoustic correction or compensation according to the principles of this invention, and though the result may not be perfect it may still involve a considerable improvement as compared with a lack of acoustic compensation.

It should be noted that for obtaining good results of the acoustic compensation as herein described the loud speakers should of course be of good quality, and they should be placed reasonably close to each other in order to avoid phase distortion of the sound result as heard by a listener.

Generally the invention provides for at least a certain degree of compensation of an irregularity of the sound signal in a crossover range between two loud speakers by electroacoustic means controlled so as to counteract the deviation of the reproduced signal from the input signal. It will be understood that this kind of correction may well be used in conjunction with an electric correction of the input signal should this be desirable. Moreover it will be understood that the important feature is the compensating form of the transfer function curve of the auxiliary driver and not primarily the manner in which this form of the curve is obtained. Thus, as well known and as described e.g. by Harry F. Olson in "Dynamical Analogies", D.van Nostrand Company, Inc., New York, p. 80–82, it is possible to design an acoustic filter which may produce the desired transfer function of the auxiliary driver, and the necessary compensation function may also be obtained by combined electric and acoustic filter means.

Figure 9:
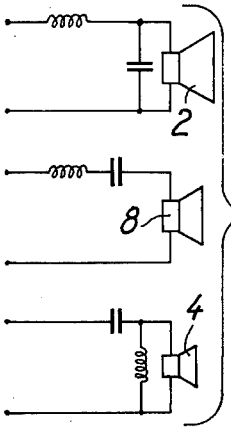
FIG. 9 illustrates the basic design of the filters associated with each driver of the invention.
Figure 10:
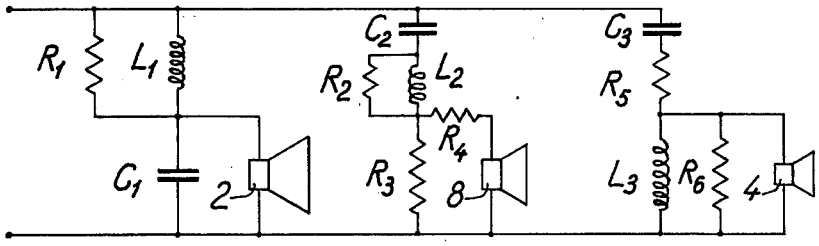
FIG. 10 illustrates a preferred design of the invention.

The principal designs of the filters of a woofer 2, a tweeter 4 and an auxiliary driver 8 are illustrated in FIG. 9. The designs may be such that in all three filters the self induction and capacity elements, respectively, may be similar. FIG. 10 is a diagram examplifying the actual filter designs in a loud speaker system according to the invention.

It should be mentioned that in connection with the example shown in FIG. 8, in which the two auxiliary drivers provide for a total additional transfer of the magnitude $$\frac{2s + 2s^2}{N_3},$$

it would be possible to use a single auxiliary driver having this total transfer function, obtained by a suitably designed filter. As mentioned, it is generally disadvantageous to make use of a filter controlled compensation, a.o. because the driver shall then work in a broadened frequency range, but this specifically applies to the main drivers. An auxiliary driver according to the invention works in a rather restricted frequency range, and under circumstances, where crossover networks of third or higher order are used, it would be possible to reduce the number of auxiliary drivers at least by one when feeding the remaining driver or drivers through an electrically corrected filter, since the actual frequency range would still be of a permissible small extension.

In the foregoing the basic types of crossover networks and filters have been considered. As well known, however, there may be used networks of higher complexity, e.g. so-called "Maximally flat sharp cut off filters", and in such cases it may be more difficult to calculate the deviation function of the main sound signal from the input signal and to thereafter design a suitable filter for the auxiliary driver or drivers, but on the other hand it is nevertheless possible to make such calculations and experiments, and the concept of the invention may in many cases be useful for obtaining a more or less perfect acoustic compensation of the actual deviations from the optimal performance of the main drivers in the loud speaker system.

A possibility further to those already described is to make use of an acoustic amplification of the sound frequencies adjacent the crossover frequency by incorporating in the loud speaker system a resonance cavity responding to the crossover frequency. For example, a tube having a length of half the wave length of the crossover frequency may be placed behind the auxiliary driver, closed at its rear end, whereby standing waves will be produced and cooperate with the rear side of the driver membrane so as to cause amplification of the transmitted sound within at least the middle portion of the crossover frequency range. Hereby it is obtainable not only that an additional transfer function is introduced which in its turn may simplify or even eliminate the electric means for producing the desired total compensation of the sound signal, but also that an auxiliary driver of reduced effect may be used.

In the system illustrated in FIG. 10 is used three drivers of 4 Ohms each. The crossover frequency is 2000 Hz, and the components are as follows: $R_1 = 8$ Ohms, $R_2 = 150$ Ohms, $R_3 = 8{,}2$ Ohms, $R_4 = R_5 = 1$ Ohm, $R_6 = 10$ Ohms, $L_1 = 2{,}6$ mH, $L_2 = 1{,}8$ mH, $L_3 = 0{,}26$ mH, $C_1 = 25\ \mu F$ og $C_2 = C_3 = 8\ \mu F$.

What is claimed is:

1. A loudspeaker system comprising a first and a second main driver connected to common signal input terminals through crossover network means designed so as to pass signals of frequencies lower than a predetermined crossover frequency to said first driver and signals of frequencies higher than said crossover frequency to the second driver, while in a crossover frequency range the signals are passed to both drivers with an amplitude which for increasing frequencies is decreasing for said first driver and increasing for said second driver in such a manner that the transfer function of the loudspeaker system is approximated to a constant function inside and is substantially constant outside said crossover frequency range, characterized in that in addition to said two drivers there is provided at least one auxiliary compensation driver adapted to work in said crossover frequency range and being operable to reproduce an acoustic signal with a frequency-amplitude characteristic which, combined with the corresponding characteristics of the two main drivers, results in the total transfer function of the loudspeaker system being substantially constant inside and outside the crossover frequency range.

2. A loud speaker system according to claim 1, in which said auxiliary driver is a usual loud speaker fed through a separate filter network designed so as to define the transfer function thereof practically exclusively in electrical terms.

3. A loud speaker system according to claim 2, in which the crossover network means of the two main drivers are of the order n, characterized in that the filter network of the auxiliary driver is designed so as to define a transfer function thereof given by the expression $$G_A = \frac{a_1 s + a_2 s^2 + \ldots . a_{n-1} s^{n-1}}{a_0 + a_1 s + a_2 s^2 + \ldots . a_n s^n},$$

in which $a_0$, $a_1$, $a_2$ are constants and s is equal to $$\frac{j\omega}{\omega_0},$$

the two main drivers being connected in phase with each other.

4. A loud speaker system according to claim 1, wherein the two main drivers reproduce an acoustic signal with a frequency-amplitude characteristic which is the same frequency amplitude characteristic of a conventional two driver loud speaker system, said two main drivers being connected in phase with each other, and said at least one auxiliary driver reproducing an acoustic signal with a frequency-amplitude characteristic which is combined with the in phase combination of the two main drivers so as to provide a total transfer function of the loud speaker system which is essentially constant inside and outside the crossover frequency range.

5. A loud speaker system according to claim 4, wherein the crossover network means for the two main drivers is of at least the second order.

6. A loudspeaker system having a plurality of main drivers for reproducing individual frequency ranges, which ranges when combined represent the entire audio frequency spectrum, comprising:

first and second main drivers covering respective adjacent frequency ranges and connected to common input terminals through passive crossover network means of at least second order designed so as to pass signals of frequencies lower than a predetermined crossover frequency to said first main driver and signals of frequencies higher than said crossover frequency to said second main driver, while in a crossover frequency range the signals are passed to both main drivers with an amplitude which for increasing frequencies is decreasing for said first driver and increasing for said second driver, said first and second main drivers cooperating with said passive crossover network means for individually reproducing an acoustic signal with a frequency-amplitude characteristic which is the same frequency-amplitude characteristic of the respective individual speakers of a conventional multiple driver loudspeaker system covering respectively adjacent frequency ranges and said first and second main drivers being connected substantially in phase with each other; and at least one auxiliary compensation driver adapted to work in said crossover frequency range and being operable to reproduce an acoustic signal with a frequency-amplitude characteristic which when combined with the corresponding characteristics of said first and second main drivers, results in the total transfer function of the loudspeaker system being substantially constant inside and outside the crossover frequency range.

7. A loud speaker system according to claim 6, in which said auxiliary driver is a usual loud speaker fed through a separate passive filter network designed so as to define the transfer function thereof practically exclusively in electrical terms.

8. A loud speaker system according to claim 7, wherein the passive filter network of the auxiliary driver is designed so as to define a transfer function thereof given by the expression $$G_A = \frac{a_1 s + a_2 s^2 + \ldots . a_{n-1} s^{n-1}}{a_0 + a_1 s + a_2 s^2 + \ldots . a_n s^n}$$

in which $a_0$, $a_1$, and $a_2$ are constants and s is equal to $$\frac{j\omega}{\omega_0}.$$

9. A loudspeaker system according to claim 6, wherein said first and second main drivers individually reproduce an acoustic signal with a frequency-amplitude characteristic which is the same frequency-amplitude characteristic of the respective individual speakers of a conventional two driver loudspeaker system, and said at least one auxiliary driver reproducing an acoustic signal with a frequency-amplitude characteristic which is combined with the substantially in phase combination of said first and second main drivers so as to produce a total transfer function of the loudspeaker which is substantially constant inside and outside the crossover frequency range.

10. A loudspeaker system comprising:

first and second main drivers connected substantially in phase to common input terminals through passive crossover network means designed so as to pass signals of frequencies lower than a predetermined crossover frequency to said first driver and signals of frequencies higher than said crossover frequency to said second driver, while in a crossover frequency range the signals are passed to both drivers with an amplitude which for increasing frequencies is decreasing for said first driver and increasing for said second driver, said first and second drivers individually reproducing an acoustic signal with a frequency-amplitude characteristic which is the same frequency-amplitude characteristic of the respective individual speakers of a conventional two-driver loudspeaker system; and at least one auxiliary compensation driver adapted to work in said crossover frequency range and being operable to reproduce an acoustic signal with a frequency-amplitude characteristic which combined with the corresponding characteristics of said first and second main drivers, results in the total transfer function of the loudspeaker system being substantially constant inside and outside the crossover frequency range.

11. A loudspeaker system according to claim 10, in which said auxiliary driver is a usual loudspeaker fed through a separate passive filter network designed so as to define the transfer function thereof practically exclusively in electrical terms.

12. A loudspeaker system according to claim 11, wherein the crossover network means of said first and second main drivers is of the order $n$ and wherein the passive filter network of the auxiliary driver is designed so as to define transfer function thereof given by the expression $$G_A = \frac{a_1 s + a_2 s^2 + \ldots . a_{n-1} s^{n-1}}{a_0 + a_1 s + a_2 s \ldots . a_n s^n}$$

in which $a_0$, $a_1$, and $a_2$ are constants and s is equal to $$\frac{j\omega}{\omega_0}.$$

13. A loudspeaker system according to claim 12, wherein the order $n$ of the crossover network means for said first and second drivers is of at least the second order.

* * * * *